US005445091A

United States Patent [19]

Bartholomä

[11] Patent Number: 5,445,091

[45] Date of Patent: Aug. 29, 1995

[54] LOOPER FOR A SINGLE-THREAD CHAINSTITCH SEWING MACHINE

[75] Inventor: Hans-Dieter Bartholomä, Filderstadt, Germany

[73] Assignee: Union Special GmbH, Germany

[21] Appl. No.: 309,097

[22] Filed: Sep. 20, 1994

[30] Foreign Application Priority Data

Sep. 22, 1993 [DE] Germany ..... 43 32 111.9

[51] Int. Cl.[6] ..... D05B 57/02; D05B 13/02

[52] U.S. Cl. ..... 112/199; 112/11; 112/169

[58] Field of Search ..... 112/10, 11, 35, 38, 112/169, 197, 198, 199, 159; 53/138.5

[56] References Cited

U.S. PATENT DOCUMENTS

| | | | |
|---|---|---|---|
| 1,929,323 | 10/1933 | Maier | 112/199 |
| 2,928,363 | 3/1960 | Saltz et al. | 112/169 |
| 3,301,206 | 1/1967 | Lanzendörfer | 112/199 |
| 3,443,539 | 5/1969 | Scharmer, Jr. | 112/11 X |
| 4,428,312 | 1/1984 | Ketterer | 112/169 X |
| 4,708,070 | 11/1987 | Hiltner | 112/10 |

FOREIGN PATENT DOCUMENTS

| | | | |
|---|---|---|---|
| 2286189 | 11/1990 | Japan | 112/199 |
| 2026563 | 2/1980 | United Kingdom | 112/199 |
| 2114168 | 8/1983 | United Kingdom | 112/199 |

OTHER PUBLICATIONS

Union Special Catalog No. 283, 3rd Edition, Published 1-91.

*Primary Examiner*—C. D. Crowder
*Assistant Examiner*—Ismael Izaguirre
*Attorney, Agent, or Firm*—Willian Brinks Hofer Gilson & Lione

[57] ABSTRACT

A looper (2) for single-thread chainstitch sewing machines comprises for the purpose of forming a chainstitch a thread guiding surface (22), which is disposed substantially parallel to the feed path of the looper. A thread driving device (23) and a thread retaining device (24), which is formed as a retaining step (25), render possible the interlinking of a sewing thread (8) with itself. (FIG. 1 )

24 Claims, 3 Drawing Sheets

LOOPER FOR A SINGLE-THREAD CHAINSTITCH SEWING MACHINE

BACKGROUND OF THE INVENTION

1. Field of the Invention

The invention relates to a looper for a single-thread chainstitch sewing machine.

2. Description of the Related Art

A known looper appears in the Union Special Catalogue No. 283, Issue 3, (published January, 1991), which describes a portable bag-sewing machine, the said looper rendering it possible to produce a single-thread chainstitch. However, when using such a looper it is necessary to use a special loop holder, in order to be able to produce the stitches correctly. The loop holder attached to a needle plate must be adjusted precisely and since during the formation of each individual stitch the loop holder engages the sewing thread guided in an arcuate curved sewing needle, the loop holder is subjected to a certain degree of wear which can lead to undesired defective stitches.

SUMMARY OF THE INVENTION

An object of the invention is to provide a looper for single-thread chainstitch sewing machines in such a way that a single-thread chainstitch, stitch type 101 according to ISO 4915 is formed using convenient means without impairing the reliability of the stitching.

In accordance with the present invention, there is provided a looper for a single-thread chainstitch sewing machine having a looper shaft, which looper cooperates in use with a needle plate and a sewing needle of the sewing machine in order to form sewing stitches on a workpiece, comprising a blade with a pointed front end, a thread guiding surface disposed in a region of the blade facing the looper shaft, a thread driving device formed adjacent to the thread guiding surface and a thread retaining device disposed in a region of the blade facing the needle plate, the looper being driven in use in such a manner as to pivot about and be displaceable transverse to a movement path of the sewing needle guiding a thread in the forward feed direction of the workpiece, the thread guiding surface being disposed substantially parallel to the feed path of the looper, the thread driving device being disposed transverse to the thread guiding surface towards the looper shaft and that the thread retaining device being formed as a retaining step offset towards the looper shaft.

By arranging the thread guiding surface substantially parallel to the feed direction of the looper, by arranging the thread driving device transverse to the thread guiding surface towards the looper shaft and by designing the thread retaining device disposed at the region of the blade facing the needle plate as a retaining step offset towards the looper shaft, it is ensured that the thread is guided at the looper in such a way that without impairing the reliability of the stitching a single-thread chainstitch, stitch type 101 according to ISO 4915 is formed by means of one sewing thread.

Preferably surfaces are allocated to the thread driving device and the retaining step of the thread retaining device to facilitate the guiding of the sewing thread along the blade of the looper.

BRIEF DESCRIPTION OF THE DRAWINGS

By way of example only, a specific embodiment of the present invention will now be described with reference to the accompanying drawings, in which.

DESCRIPTION OF THE PREFERRED EMBODIMENT

Figure 1:
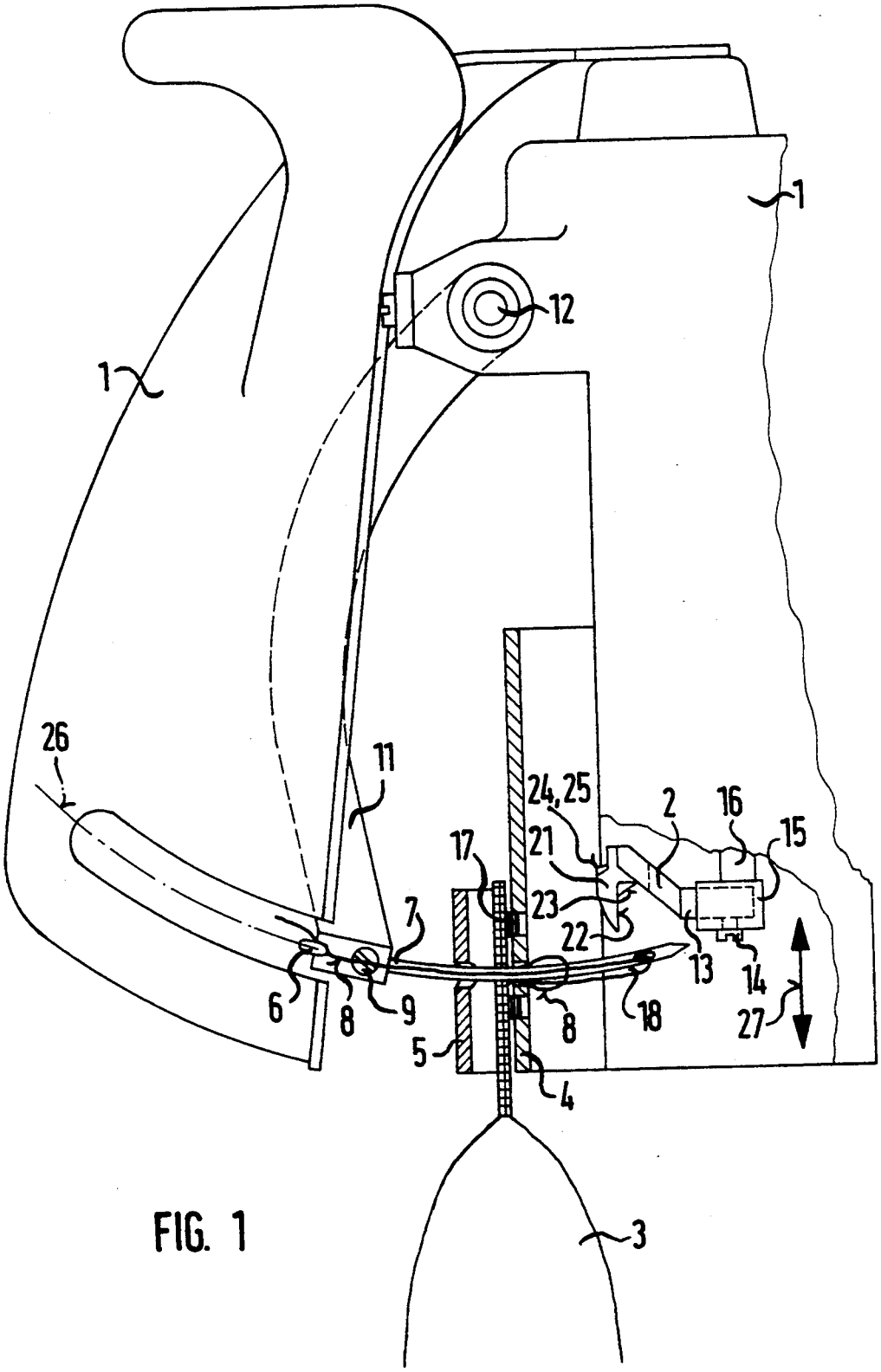
FIG. 1 is a fragmentary front view of a single-thread chainstitch sewing machine with a looper, with the looper in an upper position.

FIG. 1 illustrates a fragmentary view of a bag-sewing machine used for example for sewing a bag opening. The sewing machine comprises a sewing machine casing 1, in which a looper 2 is pivotably and displaceably mounted. A workpiece 3 which is to be stitched together so as to form a bag is guided between a needle plate 4 and a resiliently mounted presser foot 5. An annular eyelet 6 and a curved sewing needle 7 which can move in a reciprocating manner guide a sewing thread 8. The looper 2 and the sewing needle 7 are guided for example by virtue of a gearing disclosed in the U.S. Pat. No. 2,960,946, which gearing is driven by a motor. The sewing needle 7 is attached by a screw 9 to a needle lever 11, which is pivotably mounted about a point of rotation 12. A looper shank 13 of the looper 2 is attached by a screw 14 to a looper holder 15, which is supported by a looper shaft 16. A feed dog 17, also called a workpiece feeder, serves to feed the workpiece 3 forward. The looper 2 is illustrated in its upper starting position and the sewing needle 7 is illustrated in its right-hand final position. The sewing thread 8 is guided as a loop 18 through the workpiece 3 and interlinked with itself on the side of the workpiece 3 facing the looper 2 and the needle plate 4. The looper 2 comprises a blade 21 which is pointed at the front end, a thread guiding surface 22 disposed in a region of the blade 21 facing the looper shaft 16, a thread driving device 23 formed adjacent to the thread guiding surface 22 and a thread retaining device 24 disposed in a region of the blade 21 facing the needle plate 4, which thread retaining device is formed as a retaining step 25. The looper 2 is disposed in such a way as to be able to pivot and to be displaced about a movement path 26 of the sewing needle 7. A double arrow 27 clearly indicates the feed directions of the feed path of the looper shaft 16 and of the looper 2.

Figure 2:
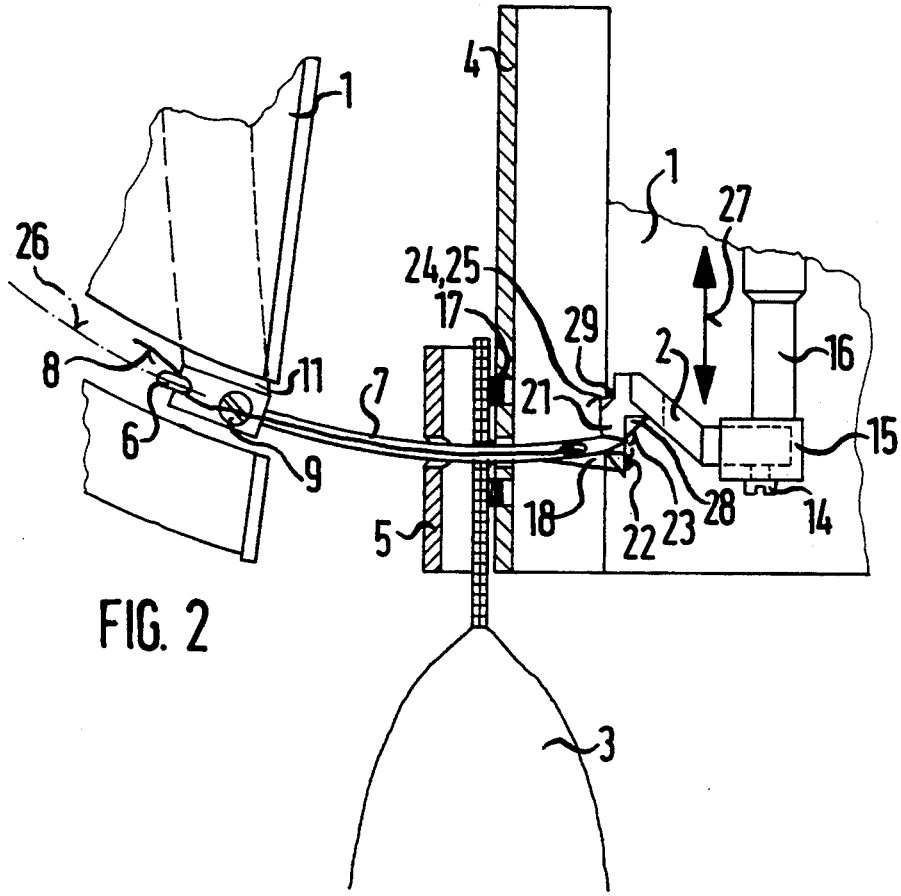
FIG. 2 is a lateral, enlarged sectional view of the sewing machine of FIG. 1, with the looper in a thread receiving position.
Figure 3:
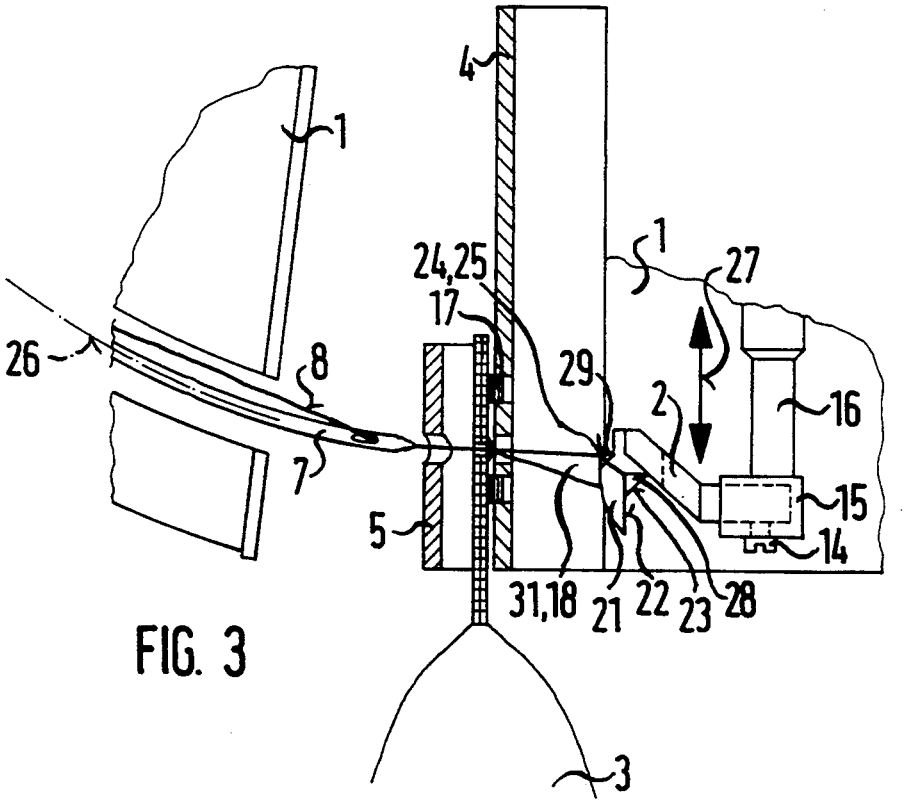
FIG. 3 is a lateral, enlarged sectional view of the sewing machine of FIG. 1, with the looper in a lowered position.

FIG. 2 illustrates the looper 2 in its thread receiving position. In comparison to FIG. 1, the sewing needle 7 has moved on its needle path 26 in a curve towards the left and in so doing enlarged the loop 18, since the sewing thread 8 is retained in the workpiece 3. The thread driving device 23, which entrains the sewing thread 8 and the loop 18 in a downwards direction, is provided with a thread driving device surface 28, against which the sewing thread 8 coming from the sewing needle 7 is supported. The thread driving surface 28 extending diagonally to the blade 21 and a retaining surface 29 extending likewise diagonally to the blade 21 facilitate the formation of a so-called thread triangle 31, as illustrated in FIG. 3, which is formed from the loop 18.

Figure 4:
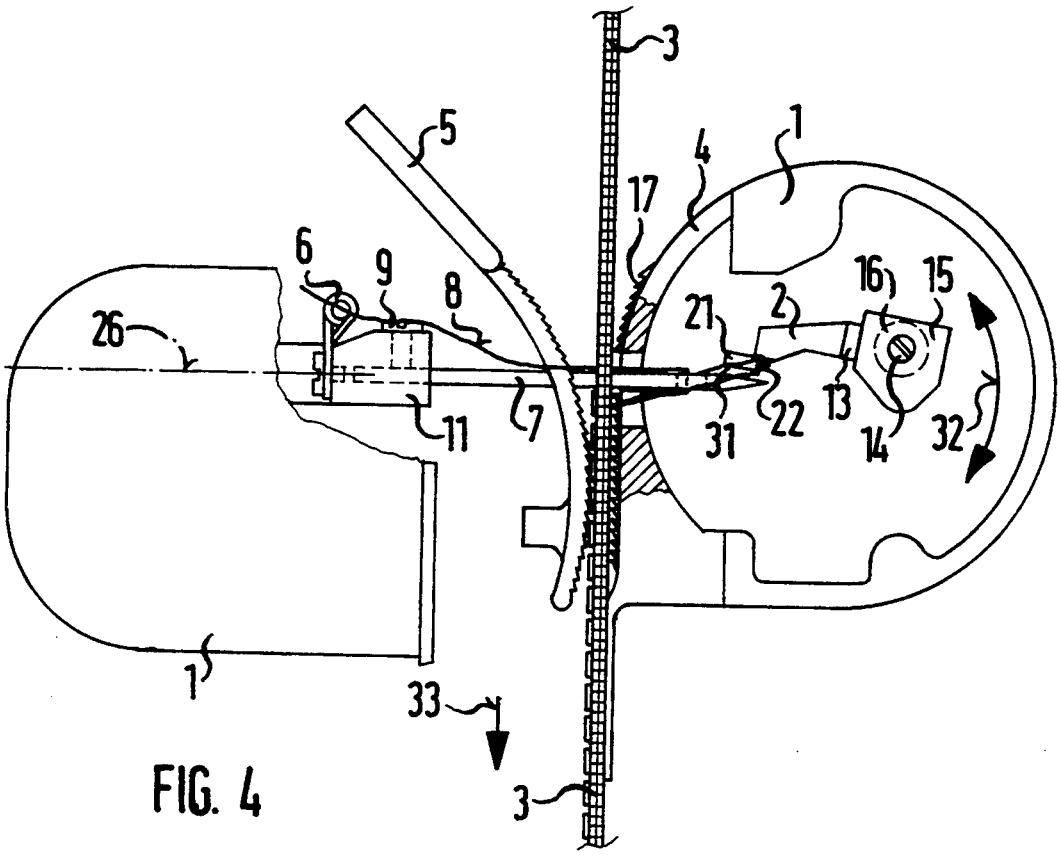
FIG. 4 is a fragmentary view from below of the sewing machine of FIG. 1 with the looper in a thread cutting-off position.

The FIG. 4 illustrates the sewing needle 7 in its movement path 26 on the way towards the right-hand final position thereof. The blade 21 of the looper 2 is in comparison to FIG. 2 disposed in advance of or above the sewing needle 7 and the sewing needle 7 is inserted or penetrates with its point into the thread triangle 31. A curved double arrow 32 clearly illustrates the pivot directions of the pivot path of the looper 2 about the looper shaft 16. An arrow 33 indicates the forward feed direction of the workpiece 3.

Figure 5:
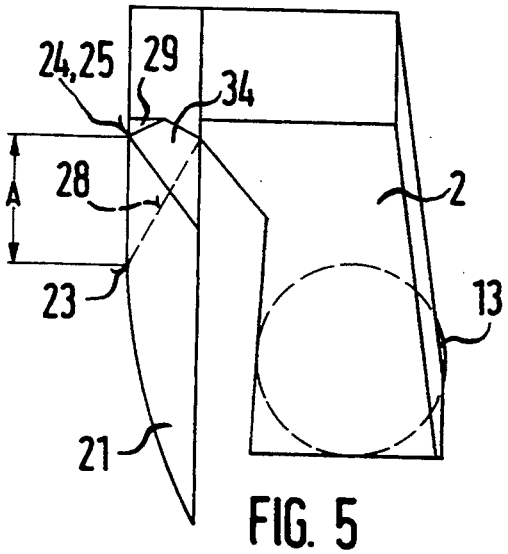
FIG. 5 is an enlarged view of the looper of FIG. 1 as seen from the side.

FIG. 5 illustrates the looper 2 as seen from the left-hand side of FIG. 1. The thread driving device 23 is disposed starting from the pointed front end of the blade 21 at a spacing A in advance of the thread retaining device 24. A further surface 34, which commences at the retaining surface 29, extends diagonally towards the front end of the blade 21 and reduces consequently the total periphery of the thread triangle 31 and thus facilitates during the stitch formation the pulling tight or rather reducing in size of the loop 18 towards the workpiece 3.

The single-thread chainstitch is formed using the looper 2 in accordance with the invention, as follows:

Based on the starting position illustrated in FIG. 1 of the thread-guiding curved sewing needle 7 in the right-hand end position and of the looper 2 in the upper end position, the movement progresses as follows: during the pivot movement of the sewing needle 7 towards the left, the loop 18 forms on the rearside thereof, into which loop 18 the looper 2 enters during its downwards movement with its blade 21 with its pointed front end, as illustrated in FIG. 2. The thread guiding surface 22 holds the loop 18 open and prevents the loop 18 from being drawn together against the side of the workpiece 3 facing the needle plate 4. As the looper 2 moves into its low position, as shown in FIG. 3, the thread driving device 23, which can be formed as an edge or surface, takes hold of the loop 18 and pulls it downwards. During the further movement of the looper 2 towards its low position, the looper 2 commences to perform its pivot movement about the looper shaft 16. The sewing thread 8 is pushed into the thread retaining device 24, which is formed as a retaining step 25 offset towards the looper shaft 16.

As the looper 2 moves into its upper end position, the sewing thread 8 forms on the rear side of the blade 21 the thread triangle 31, since the feed dog 17 moves the sewn workpiece 3 and the sewing thread 8 in the workpiece forward feed direction, as illustrated by the arrow 33 in FIG. 4. In so doing, owing to the thread retaining device 24, the sewing thread 8 is secured on the blade 21 so long as the sewing needle 7 when moving into the right-hand end position stitches and penetrates into the thread triangle 31, as illustrated in FIG. 4. During the further movement of the looper 2 into its upper end position, the sewing thread 8 which is now interlinked with itself and thus secured moves out of the thread retaining device 24, which movement is facilitated by virtue of the retaining surface 29, which is formed diagonally to the blade 21, and the further surface 34 and thereafter from the blade 21. The sewing thread 8 is looped around the sewing needle 7, as is evident in FIG. 1.

During a further pivot movement of the sewing needle 7 out of the right-hand end position towards the left, the loop 18 is formed again on its rear side and the stitch formation of the next single-thread chainstitch is carried out as described above.

I claim:

1. A looper for a single-thread chainstitch sewing machine having a looper shaft, said looper and looper shaft having a reciprocal feed path that is parallel to the looper shaft, which looper cooperates in use with a needle plate and a sewing needle of the sewing machine in order to form sewing stitches on a workpiece, comprising a blade with a pointed front end, said blade being displaced from and substantially parallel to said looper shaft, a thread guiding surface disposed in a region of the blade facing the looper shaft, a thread driving device formed adjacent to the thread guiding surface and a thread retaining device disposed in a region of the blade facing the needle plate, the looper being driven in use in such a manner as to pivot about and be displaceable transverse to a movement path of the sewing needle guiding a thread in the forward feed direction of the workpiece, the thread guiding surface being disposed substantially parallel to the feed path of the looper, the thread driving device being disposed transverse to the thread guiding surface towards the looper shaft and that the thread retaining device being formed as a retaining step offset towards the looper shaft.

2. A looper as claimed in claim 1, wherein a driver surface is provided on the thread driving device.

3. A looper as claimed in claim 2, wherein a retaining surface is provided on the retaining step.

4. A looper as claimed in claim 3, wherein a further surface is provided on the retaining surface, which further surface is formed substantially diagonally obliquely to the front end of the blade.

5. A looper as claimed in claim 4, wherein relative to said pointed front end of the blade, the thread driving device is disposed closer to said pointed front end of the blade than the thread retaining device.

6. A looper as claimed in claim 3, wherein relative to said pointed front end of the blade, the thread driving device is disposed closer to said pointed front end of the blade than the thread retaining device.

7. A looper as claimed in claim 2, wherein relative to said pointed front end of the blade, the thread driving device is disposed closer to said pointed front end of the blade than the thread retaining device.

8. A looper as claimed in claim 1, wherein a retaining surface is provided on the retaining step.

9. A looper as claimed in claim 8, wherein a further surface is provided on the retaining surface, which further surface is formed substantially diagonally obliquely to the front end of the blade.

10. A looper as claimed in claim 9, wherein relative to said pointed front end of the blade, the thread driving device is disposed closer to said pointed front end of the blade than the thread retaining device.

11. A looper as claimed in claim 10, wherein relative to said pointed front end of the blade, the thread driving device is disposed closer to said pointed front end of the blade than the thread retaining device.

12. A looper as claimed in claim 8, wherein relative to said pointed front end of the blade, the thread driving device is disposed closer to said pointed front end of the blade than the thread retaining device.

13. A sewing machine comprising; a needle plate, a sewing needle, a looper for a single-thread chainstitch having a looper shaft, said looper and looper shaft having a reciprocal feed path that is parallel to the looper shaft, which looper cooperates in use with said needle plate and said sewing needle in order to form sewing stitches on a workpiece, said looper comprising a blade with a pointed front end, said blade being displaced from and substantially parallel to said looper shaft, a thread guiding surface disposed in a region of the blade facing the looper shaft, a thread driving device formed adjacent to the thread guiding surface and a thread retaining device disposed in a region of the blade facing said needle plate, the looper being driven in use in such a manner as to pivot about and be displaceable transverse to a movement path of the sewing needle guiding a thread in the forward feed direction of the workpiece, the thread guiding surface being disposed substantially parallel to the feed path of the looper, the thread driving device being disposed transverse to the thread guiding surface towards the looper shaft and that the thread retaining device being formed as a retaining step offset towards the looper shaft.

14. A sewing machine as claimed in claim 13, wherein a driver surface is provided on the thread driving device.

15. A sewing machine as claimed in claim 14, wherein a retaining surface is provided on the retaining step.

16. A sewing machine as claimed in claim 15, wherein a further surface is provided on the retaining surface, which further surface is formed substantially diagonally obliquely to the front end of the blade.

17. A sewing machine as claimed in claim 16, wherein relative to said pointed front end of the blade, the thread driving device is disposed closer to said pointed front end of the blade than the thread retaining device.

18. A sewing machine as claimed in claim 15, wherein relative to said pointed front end of the blade, the thread driving device is disposed closer to said pointed front end of the blade than the thread retaining device.

19. A sewing machine as claimed in claim 14, wherein relative to said pointed front end of the blade, the thread driving device is disposed closer to said pointed front end of the blade than the thread retaining device.

20. A sewing machine as claimed in claim 13, wherein a retaining surface is provided on the retaining step.

21. A sewing machine as claimed in claim 20, wherein a further surface is provided on the retaining surface, which further surface is formed substantially diagonally obliquely to the front end of the blade.

22. A sewing machine as claimed in claim 21, wherein relative to said pointed front end of the blade, the thread driving device is disposed closer to said pointed front end of the blade than the thread retaining device.

23. A sewing machine as claimed in claim 20, wherein relative to said pointed front end of the blade, the thread driving device is disposed closer to said pointed front end of the blade than the thread retaining device.

24. A sewing machine as claimed in claim 20, wherein relative to said pointed front end of the blade, the thread driving device is disposed closer to said pointed front end of the blade than the thread retaining device.

* * * * *

UNITED STATES PATENT AND TRADEMARK OFFICE

CERTIFICATE OF CORRECTION

PATENT NO. : 5,445,091
DATED : August 29, 1995
INVENTOR(S) : Hans-Dieter Bartholomä

It is certified that error appears in the above-indentified patent and that said Letters Patent is hereby corrected as shown below:

Column 4,

In claim 11, line 1, delete "10" and substitute --1--.

Column 6,

In claim 24, line 1, delete "20" and substitute --13--.

Signed and Sealed this

Twenty-first Day of May, 1996

*Attest:*

Bruce Lehman

BRUCE LEHMAN

*Attesting Officer*

*Commissioner of Patents and Trademarks*